US012128465B2

(12) United States Patent
Rebeschies et al.

(10) Patent No.: US 12,128,465 B2
(45) Date of Patent: Oct. 29, 2024

(54) ROLLING APPARATUS

(71) Applicant: SMS group GmbH, Düsseldorf (DE)

(72) Inventors: Peter Rebeschies, Düsseldorf (DE); Sebastian Böcking, Düsseldorf (DE); Hendrik Langer, Düsseldorf (DE); Christian Hehmann, Düsseldorf (DE); Guido Fick, Düsseldorf (DE)

(73) Assignee: SMS group GmbH, Düsseldorf (DE)

( * ) Notice: Subject to any disclaimer, the term of this patent is extended or adjusted under 35 U.S.C. 154(b) by 252 days.

(21) Appl. No.: 17/420,485

(22) PCT Filed: Dec. 2, 2019

(86) PCT No.: PCT/EP2019/083214
§ 371 (c)(1),
(2) Date: Jul. 2, 2021

(87) PCT Pub. No.: WO2020/141033
PCT Pub. Date: Jul. 9, 2020

(65) Prior Publication Data

US 2022/0088655 A1 Mar. 24, 2022

(30) Foreign Application Priority Data

Jan. 2, 2019 (DE) ..... 10 2019 200 005.3

(51) Int. Cl.
*B21B 13/02* (2006.01)
*B21B 31/18* (2006.01)

(52) U.S. Cl.
CPC ..... *B21B 13/02* (2013.01); *B21B 31/18* (2013.01)

(58) Field of Classification Search
CPC ..... B21B 13/02; B21B 31/18
See application file for complete search history.

(56) References Cited

FOREIGN PATENT DOCUMENTS

| | | | | |
|---|---|---|---|---|
| AT | 509455 A4 | | 9/2011 | |
| CN | 2719433 Y | | 8/2005 | |
| CN | 2818000 | | 9/2006 | |
| CN | 103037993 | | 4/2013 | |
| CN | 103037993 A | * | 4/2013 | ..... B21B 31/18 |
| CN | 103128101 A | | 6/2013 | |
| DE | 3331055 A1 | | 3/1985 | |
| DE | 4417274 A1 | | 11/1995 | |
| DE | 10150690 A1 | | 4/2003 | |
| DE | 10334727 A1 | | 2/2005 | |

(Continued)

OTHER PUBLICATIONS

Pentschev, translation of CN-103037993 (Year: 2013).*

(Continued)

*Primary Examiner* — Bobby Yeonjin Kim
(74) *Attorney, Agent, or Firm* — Maier & Maier, PLLC

(57) ABSTRACT

A rolling apparatus, including a stand, at least two rolls, which are attached to the stand by chocks and are displaceable in relation to one another in the axial direction, and at least one axial displacing device, which is assigned to a chock of at least one of the rolls and can act on this chock. The axial displacing device has a fixed block, at least one displaceable bending block and at least one displacing cylinder, which is assigned to the bending block and by which the bending block can be displaced in relation to the fixed block. The fixed block is of a multipart form.

7 Claims, 4 Drawing Sheets

(56) References Cited

FOREIGN PATENT DOCUMENTS

| | | | |
|---|---|---|---|
| EP | 1436104 | B1 | 1/2005 |
| EP | 1648626 | B1 | 11/2007 |
| EP | 2572808 | A1 | 3/2013 |
| JP | 4928653 | B1 | 5/2012 |

OTHER PUBLICATIONS

International Search Report (with English translation) and Written Opinion (with Machine translation) issued on Mar. 25, 2020 in corresponding International Application No. PCT/EP2019/083214; 23 pages.
International Preliminary Report on Patentability issued on Dec. 8, 2020 in corresponding International Application No. PCT/EP2019/083214; 45 pages; Human and Machine translation attached.
Office Action issued on Oct. 25, 2022, in corresponding Chinese Application No. 2019800086018.9, 9 pages.
Application for Annulment issued on Mar. 22, 2024, in corresponding Japanese Patent No. 7189346, 106 pages.
Uwano et al., "Large-Sized Cast and Forged Steels for Rolling Mills", Hitachi Review Special Issue No. 29, May 1952, 11 pages.

* cited by examiner

ROLLING APPARATUS

FIELD

The invention relates to a rolling apparatus, comprising a stand, at least two rolls, which are attached to the stand by means of chocks and are displaceable in relation to one another in the axial direction, and at least one displacing device, which is assigned to a chock of at least one of the rolls and can act on this chock. The axial displacing device has a fixed block, a displaceable bending block, and a displacing cylinder, using which the bending block can be displaced relative to the fixed block.

BACKGROUND

According to the prior art, rolls (for example working rolls and/or support rolls) can be used in rolling apparatuses, which can be displaced axially in relation to one another to thus set different rolling gap profiles. This is known, for example, from EP 1 648 626 B1, EP 1 436 104 B1, or also AT 509 455 A4. An axial displacing device is used here, which can act on, for example, the work rolls of a rolling apparatus or on the work roll chocks thereof, for the purpose of the mentioned displacement, for example of the work rolls.

A conventional axial displacing device 8 of a rolling apparatus is shown in FIGS. 4 and 5. This device comprises a one-part fixed block 10 (FIG. 4) having a central guide web 11, which extends horizontally. Retention bars 17, 18 are formed on the fixed block 10 above and below this guide web. The one-part fixed block 10, which consists of the central guide web 11 and the two retention bars 17, 18, is produced as a T-shaped forged part.

The conventional axial displacing device 8 has an upper bending block 12 and a lower bending block 13. These bending blocks 12, 13 are respectively arranged on both sides of the central guide web 11 of the fixed block 10, and are displaceably guided between the guide web 11 and the outer retention bars 17, 18. Displacing cylinders 14, the piston rods 15 of which are fixedly connected to an end plate 20 attached to the fixed block 10, are received inside each of the bending blocks 12, 13. A displacement of the two bending blocks 12, 13 relative to the fixed block 10 or its central guide web 11 is achieved by an actuation of these displacing cylinders 14. This is illustrated in the perspective view of FIG. 5.

In the conventional axial displacing device 8 according to FIGS. 4-5, the fixed block 10 is of a one-part form as explained, in general as a forged part, with the disadvantage of high raw part costs and a restricted availability in the event of possible need of repair. In addition, the manufacturing and assembly of this one-part fixed block 10 are complex. This is because the design of this forged part is oriented to the highly-loaded guide web 11, along which the two bending blocks 12, 13 are displaceably guided.

A further disadvantage of this conventional axial displacing device 8 is that the displacing cylinders are integrated inside the movable bending blocks 12, 13. This makes hose fittings for these displacing cylinders necessary, for the purpose of supplying required operating means (for example hydraulic oil). The integration of the displacing cylinders inside the bending box also has the result that these blocks have a long structure corresponding to the stroke of the displacing cylinders and thus disadvantageously occupy a large installation space. Maintenance or repair of the displacing cylinders requires a removal of the bending blocks, wherein the axial displacing system has to be nearly completely removed with the aid of a removal apparatus. This also disadvantageously results in high costs.

SUMMARY

The invention is accordingly based on the object of providing a rolling apparatus in which an axial displacing device for adjusting the rolls is producible with less effort and more cost-effectively.

This object is achieved by a rolling device specified by the features of claim 1. Advantageous refinements of the invention are defined in the dependent claims.

A rolling apparatus according to the present invention is used to be able to variably set a rolling gap in rolling operation. Such a rolling apparatus comprises a stand, at least two rolls, which are attached to the stand by means of chocks and are displaceable in relation to one another in the axial direction, and at least one displacing device, which is assigned to a chock of at least one of the rolls and can act on this chock. The axial displacing device has a fixed block, at least one displaceable bending block, and at least one displacing cylinder, using which the bending block can be displaced relative to the fixed block. The fixed block is of a multipart form and has a central displacing bracket and two separate retention bars separate therefrom, which are arranged adjoining the displacing bracket and respectively above and below it and are mounted on roll supports of the stand. The central displacing bracket is formed as an individual part.

The invention is based on the essential finding that it is possible due to the multipart form of the fixed block to only design its central part, which is used to guide and receive the displaceable bending blocks, accordingly. It is expedient here if the fixed block—as the central part—has a central displacing bracket, which has the required properties for holding and guiding the bending blocks. For example, this displacing bracket can be formed as an individual part, in particular in the form of a forged part or can be produced from forged rod material. In contrast, the edge regions of the fixed block, which can be formed separately from the displacing bracket as retention bars, can be produced as separate single parts, in particular from inexpensive sheet metal, because these retention bars—corresponding to their name—only assume a retention function of the bending blocks. Therefore, the multipart fixed block comprises three functional regions, which are formed in detail from the displacing bracket and the two outer (upper+lower) retention bars.

Due to the above-explained multipart nature of the fixed block, on the one hand, its raw part costs are reduced, since standard dimensions or standard material in the form of semifinished products can be used, and, on the other hand, the assembly costs for the axial displacing device are also reduced, because the assembly is facilitated thanks to the smaller components. Furthermore, less support window play is achieved for the rolling apparatus, since adding together the fixed block tolerances is dispensed with.

In an advantageous refinement of the invention, outside a bending block, the displacing cylinder assigned to it can be flanged onto an end plate connected to the fixed block, wherein a piston rod of the displacing cylinder interacts with the bending block.

In the last-mentioned refinement of the invention, the essential advantage is that the displacing cylinders used here can be standard cylinders, which can be acquired cost-effectively as purchased parts. In this way, these displacing cylinders can be kept ready as reserve parts, which results in improved maintenance and repair friendliness for the invention. A further advantage of this external arrangement of the displacing cylinders, i.e., outside the bending box, is that an axial length of the bending blocks in the direction of their displacing direction can thus be selected to be smaller, because this length is nearly independent of the displacing stroke. A more compact structure is advantageously achieved for the bending blocks in this way.

The above-explained external arrangement of the displacing cylinders on the end plate of the fixed block is to be understood in the meaning of the present invention in such a way that a modular construction of the bending blocks, on the one hand, and the displacing cylinders, on the other hand, is achieved in this way, so that these elements form independent structural units. In this way, it is possible to vary the displacing stroke by replacing the displacing cylinder, without having to modify the bending blocks. Installation and removal of the above-mentioned structural units is facilitated in this way.

In an advantageous refinement of the invention, it can be provided that one displacing cylinder, preferably the displacing cylinders, is/are (each) equipped with a fixed pipe system for the purpose of supplying operating means, for example hydraulic oil. A permanent connection of the displacing cylinders to a supply unit for the operating means is achieved in this way, wherein disadvantageous hose fittings, which are possibly to be disconnected from the displacing cylinders, are dispensed with.

Further advantages of the invention are established by the following aspects:

- better accessibility and more compact structure, thanks to the explained multipart form of the fixed block;
- because of the division of the fixed block into three functional regions (namely (i) displacing bracket, and (ii) and (iii) upper+lower retention bars), suitable materials and manufacturing methods can be selected deliberately in accordance with the loads;
- improved maintenance and assembly, thanks to a weight reduction of the individual components.

BRIEF DESCRIPTION OF THE FIGURES

Exemplary embodiments of the invention are described in detail in the following on the basis of a schematic simplified drawing.

In the figures.

DETAILED DESCRIPTION

Figure 1:
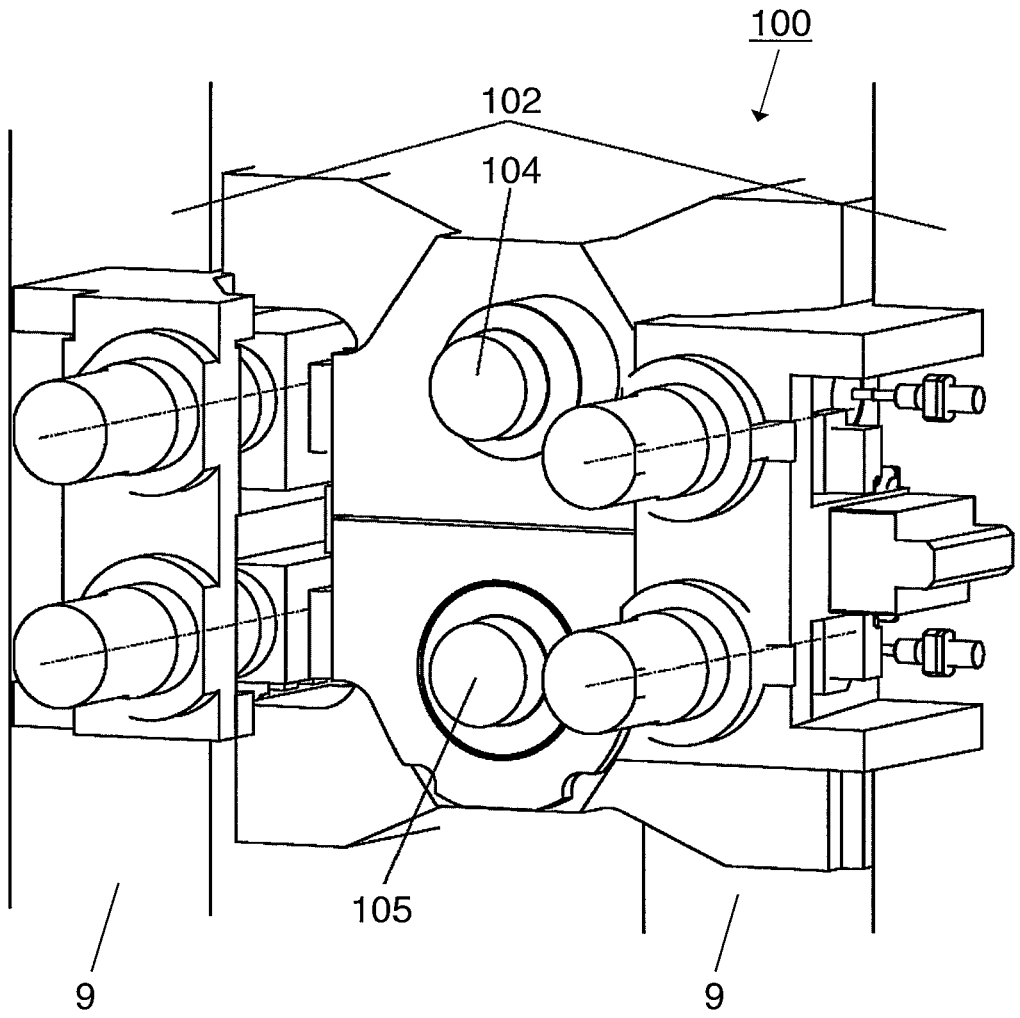
FIG. 1 shows a perspective view of two lateral spars of a rolling apparatus according to the invention.

A preferred embodiment of a rolling apparatus 100 according to the invention is illustrated and explained hereinafter with reference to FIGS. 1 to 3, in which by means of an axial displacing device 108 (cf. FIG. 3), a rolling gap (not shown) can be set variably in rolling operation of the rolling apparatus 100. Identical features in the drawing are each provided with identical reference numerals. It is particularly to be noted here that the drawing is solely shown in simplified form and in particular not to scale.

FIG. 1 shows by way of example the rolling apparatus 100, which is designed as a so-called four-high mill, in which two working rolls 104, 105 and adjoining thereto two backup rolls (not shown) are provided on a stand 102. Alternatively thereto, a different number of rolls is also possible, for example in the form of a six-high mill, in which additional intermediate rolls are also provided between the working rolls and the backup rolls. In any case, a rolling gap for the material or metal strip to be rolled is formed between the working rolls 104, 105. The profile of this rolling gap is set by an adjustment of the working rolls 104, 105. In this case, the profile of the rolling gap can be set suitably with the aid of the axial displacing device 108.

According to the illustration in FIG. 1, the two working rolls 104, 105 are held in the stand 102 of the rolling apparatus 100, wherein the spars 9 of a support of this stand 102 are also shown. At least one of the working rolls 104, 105 can be displaced in the direction of its axial extension by the axial displacing device 108. Further details of this axial displacing device 108 are explained in more detail hereinafter.

Figure 2:
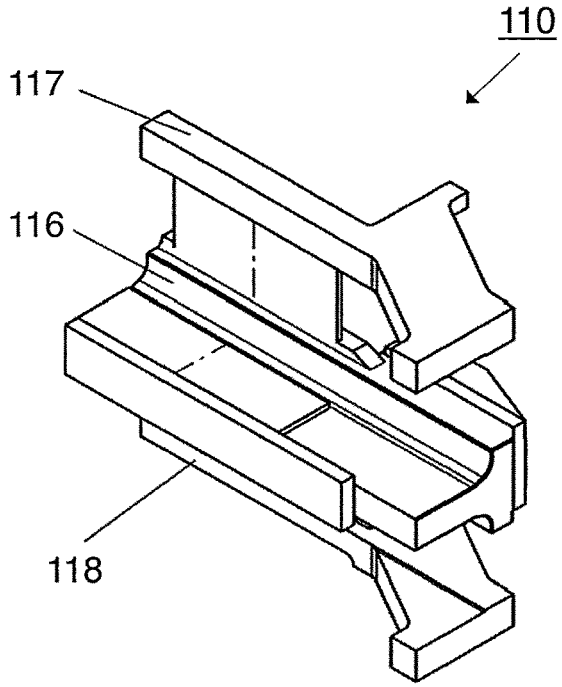
FIG. 2 shows a perspective view of a fixed block as part of an axial displacing device, which is used in the rolling apparatus of FIG. 1.
Figure 3:
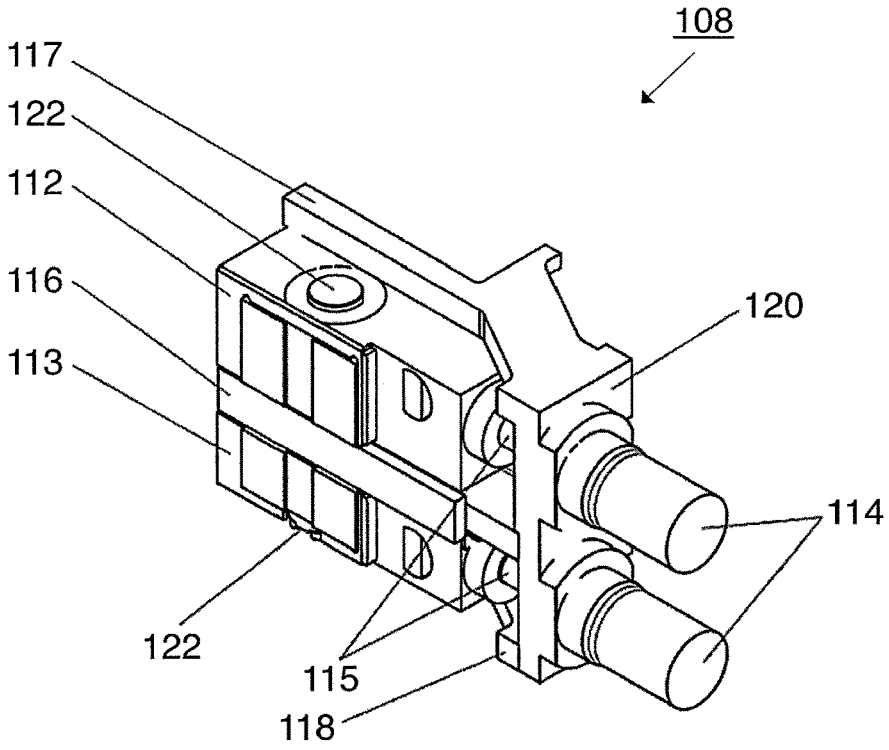
FIG. 3 shows a perspective view of an axial displacing device which is used in the rolling apparatus of FIG. 1.
Figure 4:
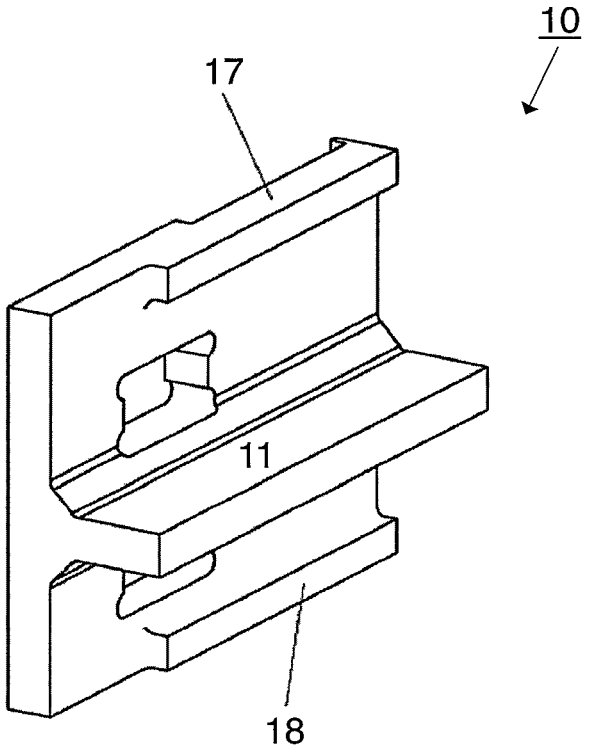
FIG. 4 shows views of a conventional axial displacing device and parts thereof.
Figure 5:
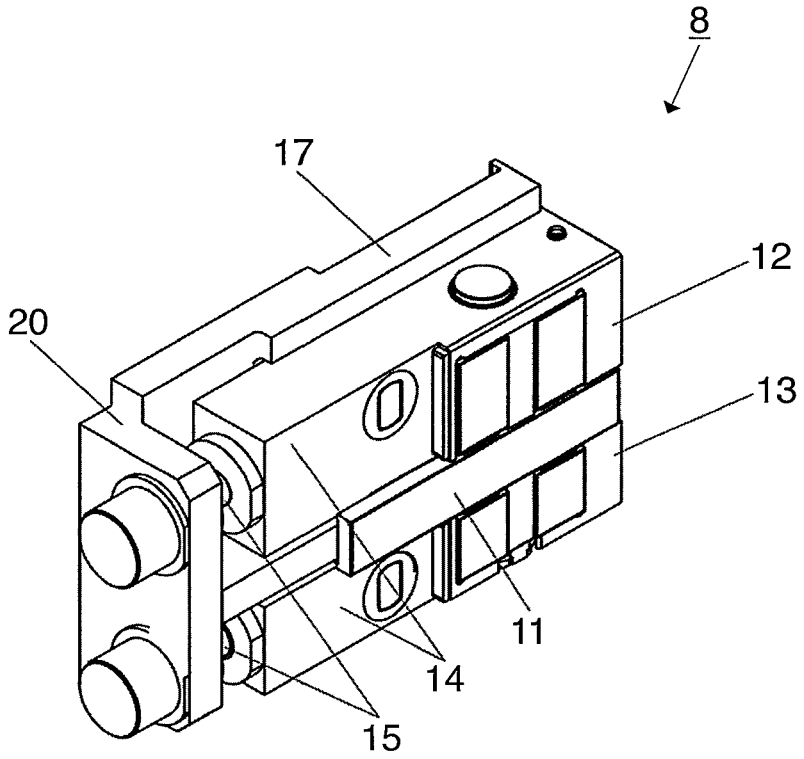
FIG. 5 shows views of a conventional axial displacing device and parts thereof.

The axial displacing device 108—as is apparent from the perspective view of FIG. 2—comprises a fixed block 110, which is of a multipart form, namely in the form of a central displacing bracket 116 and separate therefrom two separate retention bars in the form of an upper retention bar 117 and a lower retention bar 118. The retention bars 117, 118 are installed on the roll supports of the stand 103 of the rolling apparatus 100 (cf. FIG. 1).

The axial displacing device 108 comprises displaceable bending blocks, namely an upper bending block 112 and a lower bending block 113, wherein these bending blocks 112, 113 are displaceably guided along the displacing bracket 116. Specifically, the upper bending block 112 is arranged between the displacing bracket 116 and the upper retention bar 117, wherein the lower bending block 113 is arranged between the displacing bracket 116 and the lower retention bar 118. This is shown in the perspective view of FIG. 3.

Displacing cylinders 114 are respectively provided for displacing the bending blocks 112, 113 along the displacing bracket 116, which cylinders are each arranged outside the bending blocks 112, 113 and are flanged onto an end plate 120 connected to the fixed block 110. The piston rods of the displacing cylinders 114 penetrate the end plate 120 and are fastened on the bending blocks 112, 113. The bending blocks 112, 113 are displaced as intended along the displacing bracket 116 or relative thereto by actuating the displacing cylinders 114.

It is to be particularly noted at this point that the feature according to which a piston rod 115 (cf. FIG. 3) of a displacing cylinder 114 interacts with an (assigned) bending block 112, 113 is to be understood to mean that the piston rod 115—as just explained—is connected using an end side thereof fixedly to the bending block 112, 113. As a result, the bending block 112, 113, upon a translational movement of the piston rod 115, is displaced synchronously thereto along the displacing bracket 116, namely in both directions.

The bending blocks 112, 113 of the axial displacing device 108 can be assigned working roll chocks (not shown) and can act on these chocks upon an actuation of the displacing cylinders 114. A displacement of the bending blocks 112, 113 thus results in a corresponding axial displacement of the working rolls 104, 105, whereby a desired profile of the rolling gap is achieved.

A bending cylinder 122 is accommodated in each of the bending blocks 112, 113 (cf. FIG. 3), using which a targeted bending of an assigned working roll is achieved. Only the head of such a bending cylinder 122 can be seen in the illustration of FIG. 3.

A supply of the displacing cylinders 114 with operating means, in particular with hydraulic oil, can be achieved by a pipe system (not shown), which is preferably connected fixedly or permanently to the displacing cylinders 114.

The bending blocks 112, 113, on the one hand, and the displacing cylinders 114, on the other hand, are constructed modularly and are thus designed as independent structural units. This enables simple and inexpensive installation of the axial displacing device 108 and if needed also a possible replacement of these structural units in case of required repairs or maintenance of the rolling apparatus 100 according to the invention.

LIST OF REFERENCE NUMERALS

100 rolling apparatus
102 stand
103 spars (of a support of the stand 102)
104-105 rolls
108 axial displacing device
110 fixed block
112 upper bending block
113 lower bending block
114 displacing cylinder
115 piston rod (of a displacing cylinder 114)
116 central displacing bracket
117 upper retention bar
118 lower retention bar
120 end plate (of the fixed block 110)
122 bending cylinder

The invention claimed is:

1. A rolling apparatus, comprising:

a stand, at least two rolls, which are attached to the stand and are displaceable in relation to one another in the axial direction, and at least one axial displacing device, which is assigned to at least one of the two rolls and can adjust the assigned roll, wherein the axial displacing device further comprises:

a central displacing bracket, an upper retention bar, a lower retention bar, wherein the upper retention bar and the lower retention bar are respectively disposed above and below the central displacing bracket and mounted on roll supports of the stand, an upper bending block between the central displacing bracket and the upper retention bar, a lower bending block between the central displacing bracket and the lower retention bar, and displacing cylinders which are assigned coaxially to each respective bending block and by which each respective bending block is configured to be displaced synchronously together with the at least two rolls, and a respective bending cylinder is accommodated in each of the bending blocks.

2. The rolling apparatus as claimed in claim 1, wherein the central displacing bracket is formed in the form of a forged part.

3. The rolling apparatus as claimed in claim 2, wherein the central displacing bracket is produced from forged rod material.

4. The rolling apparatus as claimed in claim 1, wherein the retention bars are each produced as single parts from sheet metal.

5. The rolling apparatus as claimed in claim 1, wherein the retention bars are mounted on spars of a support of the stand.

6. The rolling apparatus as claimed in claim 1, wherein each displacing cylinder assigned to each respective bending block is flanged onto an end plate connected to the fixed block, and a piston rod of each displacing cylinder interacts with each respective bending block.

7. The rolling apparatus as claimed in claim 1, wherein the bending blocks and the displacing cylinders are constructed modularly as independent structural elements.

* * * * *